United States Patent [19]

Crump et al.

[11] 3,990,564

[45] Nov. 9, 1976

[54] RIBBON DRIVE MECHANISM

[75] Inventors: Leslie L. Crump, Trumansburg; Alexander J. Rakowski, Ithaca; Victor J. Italiano, Trumansburg, all of N.Y.

[73] Assignee: NCR Corporation, Dayton, Ohio

[22] Filed: June 25, 1975

[21] Appl. No.: 590,184

[52] U.S. Cl. ..... 197/151; 197/1 R; 197/168

[51] Int. Cl.[2] ..... B41J 33/04; B41J 33/20

[58] Field of Search ..... 101/93.04, 93.05, 336; 197/151, 1 R, 168, 152

[56] References Cited

UNITED STATES PATENTS

| | | | |
|---|---|---|---|
| 2,103,734 | 12/1937 | Schmidt | 197/168 X |
| 2,603,336 | 7/1952 | Julliard | 197/168 X |
| 3,283,876 | 11/1966 | Kern | 197/168 |
| 3,819,028 | 6/1974 | Drilliek | 197/151 X |
| 3,841,459 | 10/1974 | Buschmann et al. | 197/158 X |

*Primary Examiner*—Clifford D. Crowder
*Assistant Examiner*—Paul T. Sewell
*Attorney, Agent, or Firm*—J. T. Cavender; Wilbert Hawk, Jr.; George J. Muckenthaler

[57] ABSTRACT

A pair of compensating wheels are carried by a print head carriage in position to ride on record media being printed and are rotatably driven by frictional contact therewith, the wheels having overriding clutches associated with their respective shafts to permit driving of one shaft and its gear in alternate manner with the other shaft and its gear. The respective driving gear engages with a driven gear on a third shaft for rotation thereof and thereby drives the ribbon in one direction. Upon return of the print head carriage in the opposite direction, the action of the overriding clutches is reversed to permit driving of the other shaft while the first shaft and its wheel are free wheeling. Regardless of the direction of travel of the print head carriage, the ribbon drive shaft is rotated in the same direction.

15 Claims, 4 Drawing Figures

RIBBON DRIVE MECHANISM

BACKGROUND OF THE INVENTION

In the rapid advancement of the matrix type printer and the use of a ribbon cassette associated therewith, it is desirable to provide an inking ribbon and the drive therefor in design and in mechanism to enable high speed operation and to obtain longer ribbon life. While an inking ribbon may be of the pre-inked or self-inked type contained in a canister and appropriately designated a "throw-away" type, another type of ribbon may be contained in a canister which includes a re-inking feature for much longer ribbon life. Of more recent design, the matrix print head carries a ribbon cassette along therewith in its travel across the paper or like record media, the ribbon being utilized and driven during the printing cylce or in one direction of print head operation and not being driven during the non-printing cycle or other direction of print head travel.

Representative prior art of a printer ribbon feed is disclosed in Murphy U.S. Pat. No. 3,726,381, wherein a cassette contains supply and take-up means for the ribbon, the ribbon remaining stationary during a printing operation with left-to-right movement of the print head and the ribbon being driven during a non-printing operation when the print head moves in the opposite direction. Buschmann et al. U.S. Pat. No. 3,841,459 shows a further such feed having a movable carriage assembly and ink ribbon control which includes wind-up and wind-off spools and a gear unit that is coupled with a stationary unit and which moves the ribbon spools by moving the carrier assembly.

SUMMARY OF THE INVENTION

The present invention relates to ribbon drive mechanisms and more particularly to a drive mechanism for an endless ribbon contained in a cassette and carried by a print head which travels back and forth across the printing machine adjacent the paper or like media on which printing is to be performed. The matrix print head is caused to be moved in side-to-side manner by suitable drive means in the nature of lead screw apparatus or by cord and pulley structure, the head having a pair of wheels, aptly termed compensating wheels, associated therewith and in contact with the paper whereby the wheels are frictionally driven in one or the other direction of rotation depending upon the direction of travel of the print head. The wheels have an overriding clutch and a drive gear on their respective shafts and connected in a manner to provide driving of one wheel while permitting free rotation of the other wheel. One of the wheels has a second gear on its shaft and is rotatable with the drive gear and also engageable with a ribbon drive gear on a shaft for driving the ribbon in one direction of travel.

In a preferred construction, as the print head is caused to be moved in a right-to-left direction by such lead screw apparatus for a printing cycle of operation, the compensating wheels, by reason of their contact with the paper, and their associated gears are rotated in a counter clockwise direction, one or the first wheel rotation causing its associated clutch to be engaged with its respective shaft and to drive the gear or gears thereon in the counter clockwise direction, while the other or second wheel rotation is in the same direction and, by reason of the particular construction of the associated overriding clutch in relation to its shaft, such clutch is disengaged therefrom to permit free rotation of the second wheel. The first wheel with its associated gear has a smaller gear on its common shaft, also rotating in a counter clockwise direction and engageable with a ribbon drive gear on a ribbon drive shaft and rotating such ribbon drive gear and shaft in a clockwise direction. As the print head is caused to be moved in a left-to-right or return direction of travel, each wheel is rotated in a clockwise direction, by reason of their contact with the paper, and the second of said wheels becomes the driving member and its associated overriding cluth is caused to be engaged with its associated shaft whereby the shaft and gear are driven in the clockwise direction, while the overriding clutch associated with the first of said wheels is disengaged from its shaft and the various parts are free to rotate without driving the gears. Again the smaller gear on the shaft with the first wheel is rotating in a counter clockwise direction which drives the ribbon drive gear and its shaft in a clockwise direction, thereby driving the ribbon in the same direction regardless of travel of the print head. While printing may be performed in either one or both directions of travel of the print head, the printing ribbon is always driven in the same direction.

In view of the above discussion, the principal object of the present invention is to provide a ribbon drive mechanism associated with and responsive to the travel of a print head.

Another object of the present invention is to provide a ribbon drive mechanism which advances the ribbon throughout travel of the print head, doing so in the same direction regardless of direction of travel of the print head.

An additional object of the present invention is to provide a ribbon drive mechanism initiated from frictional contact of wheel members with paper or like media.

A further object of the present invention is to provide positive drive mechanism for advancing an inked ribbon supported from a reciprocating print head, the ribbon being advanced in the same direction past the print head.

Additional advantages and features of the present invention will become apparent and fully understood from a reading of the following description taken together with the annexed drawing, in which.

Figure 1:
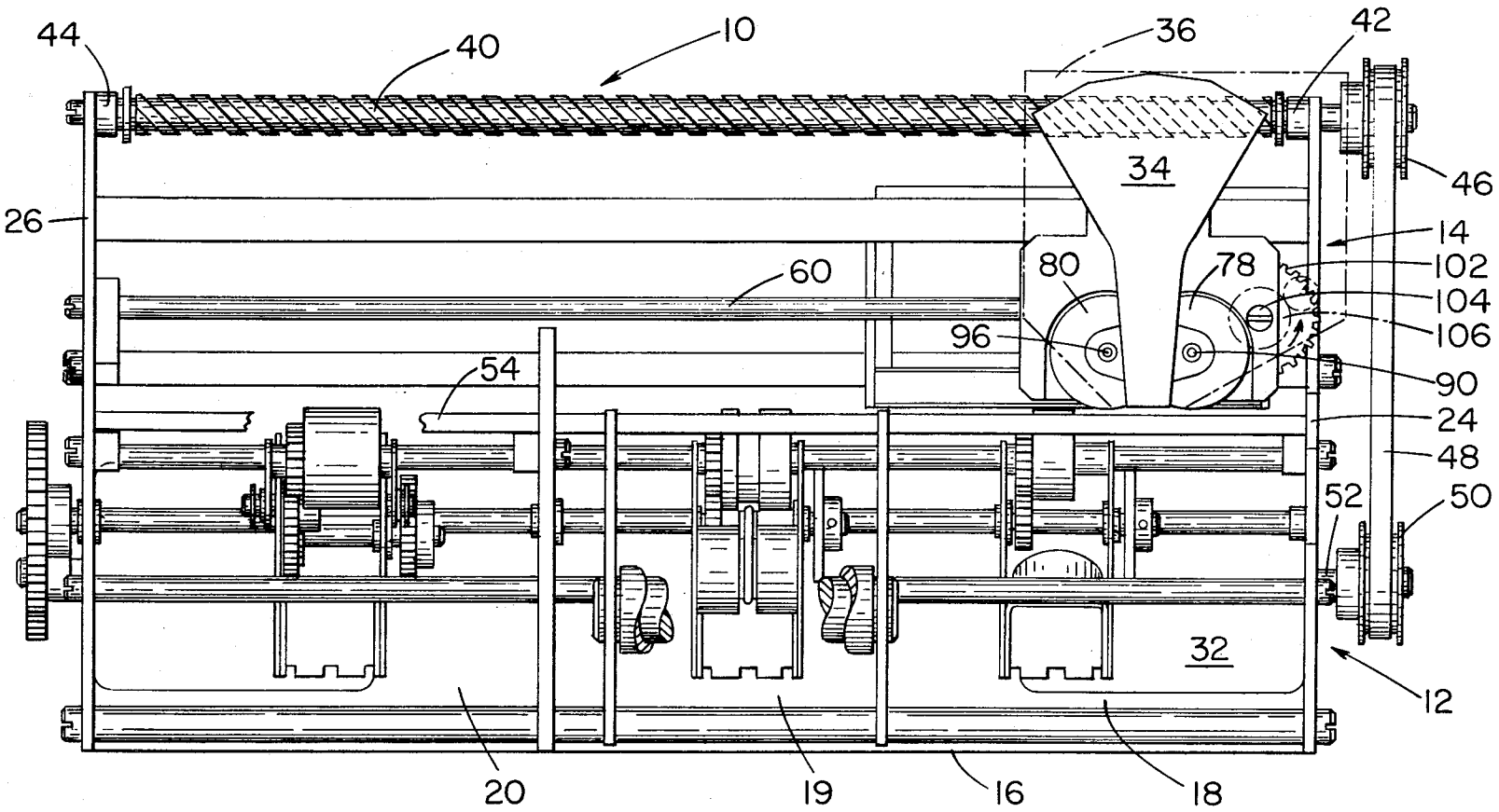
FIG. 1 is a front elevational view of a printer incorporating the subject matter of the present invention.
Figure 2:
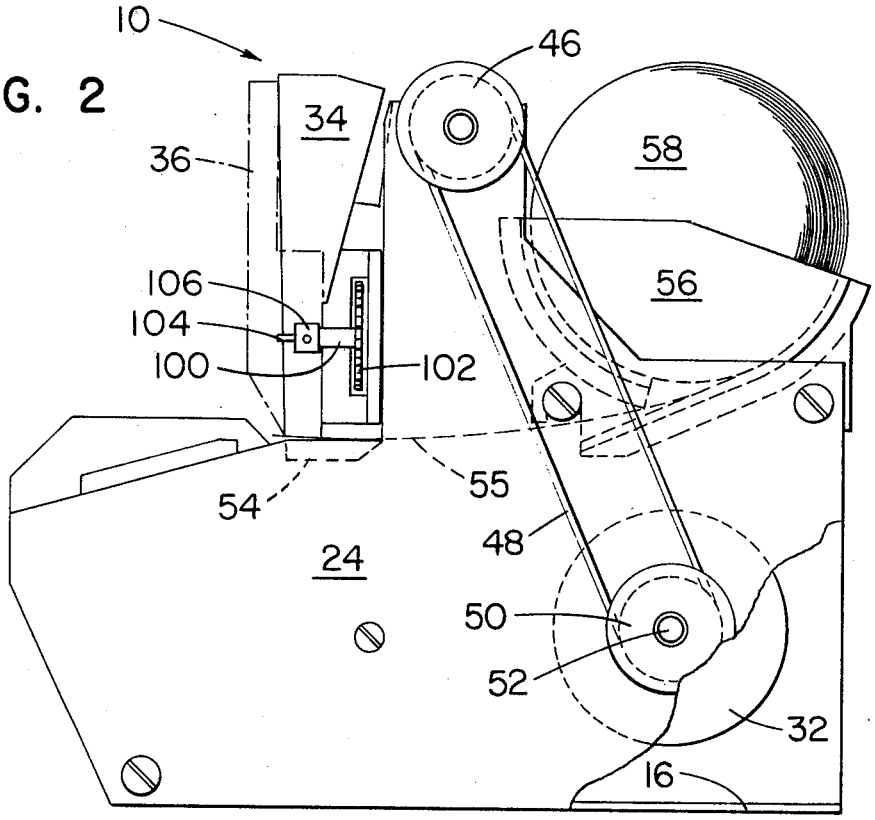
FIG. 2 is a right side elevational view of the printer shown in FIG. 1.

Referring to FIGS. 1 and 2 of the drawing which show, in limited structural illustration, the general outline and certain features of a printer with which the present invention is useful, a business machine, designated generally as 10, has lower and upper portions 12 and 14, respectively, the lower portion including a supporting base 16 and compartments 18, 19 and 20 for containing various machine elements not a part of the present invention; however, suffice it to say that the printer may include one or more function or printing stations in the nature of a receipt station, a journal station, and a slip or form station. The machine includes side walls 24 and 26 connected by suitable rods or rail members for supporting or carrying the machine elements, there being a pair of spaced members across the machine for a purpose to be later described, along with additional frame members for carrying the printing mechanism.

A prime mover in the form of a motor 32 is located at the right, lower, rear area of the machine lower portion 12 and such motor supplies energy for the various operating members of the machine, one of which is a printing mechanism which is made to travel in a side-to-side direction while effecting the printing operation. Although the printing mechanism may be one of several types, the present invention is directed to a design which includes a matrix type printer or print head 34, positioned in a generally upright manner and carried or driven back and forth across the machine. Forward of the print head and connected thereto to be carried thereby is a ribbon cassette 36, the structure of which is fully disclosed in a copending application covering the invention of Hillis L. Wilson, U.S. Ser. No. 467,418, filed May 6, 1974, now abandoned, and assigned to the same assignee as the present invention.

The print head 34 and cassette 36 are moved in such back and forth motion by means of a lead screw 40 which is positioned across the top of the machine and which is journaled in a bearing 42 at side wall 24 and in a bearing 44 at side wall 26. A timing pulley 46 is supported at the right side of lead screw 40 and a timing belt 48 connects the pulley 46 with a pulley 50 on the motor shaft 52. By appropriate control mechanism, the motor 32 drives, by means of the pulleys 46, 50 and the belt 48, the lead screw 40 to move the print head 34 and the cassette 36 in the desired side-to-side motion for printing. A guide or support rod 60 is spaced downwardly from the lead screw 40 and maintains the print head in precise position in such side-to-side motion. A level surface in the nature of a platen 54 (FIGS. 1 and 2) extends across the machine and a tray 56 supports one or more paper rolls 58 which serve as supply means for paper 55 as it is being advanced past one or more of the printing stations.

Figure 3:
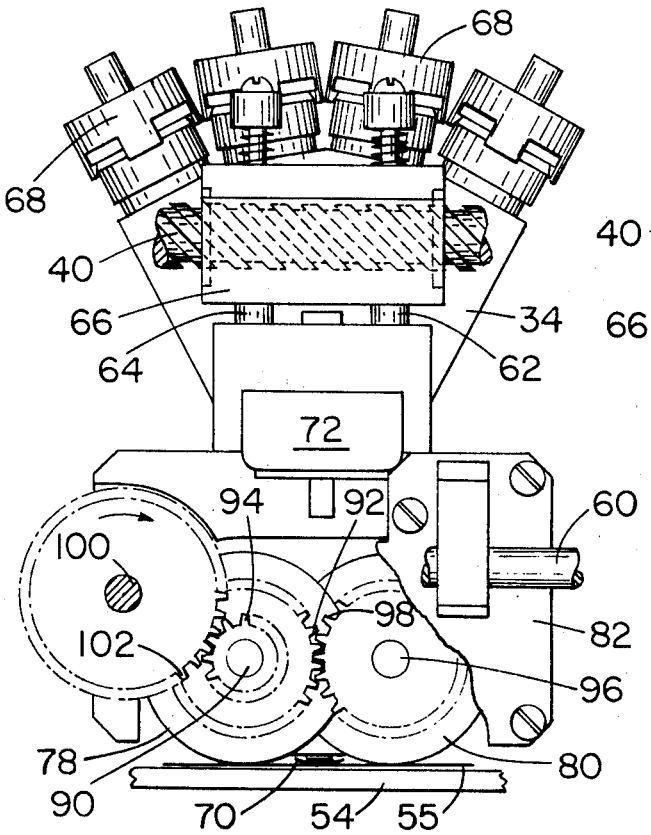
FIG. 3 is an enlarged rear elevational view of a print head and the drive mechanism for the ribbon drive shaft.

Referring now to FIG. 3, which shows a rear elevational view of the print head 34 and the ribbon drive means in more detailed manner, the head 34 is carried on the lead screw 40 and on the rod 60 to effect a straight and parallel movement of the head for the printing operation. The print head 34 is supported from a pair of vertical, spaced shafts 62 and 64 which ride in suitable bearings mounted in a nut sleeve 66, which also acts as a driven element for the driving screw 40. Since it is common practice to provide means for raising and lowering the print head 34 in relation to the paper or record media 55 during the nonprinting and printing cycle, respectively, a solenoid 72 may be useful for the raising and lowering operation. During the printing direction of travel, the face of the print head 34 is lowered to be nearly in contact with the paper 55 as it is advanced across the platen 54. Although additional structure and devices are necessary to provide complete control over the rising and lowering of the head 34, such further explanation is not here necessary as this feature forms no part of the present invention.

Figure 4:
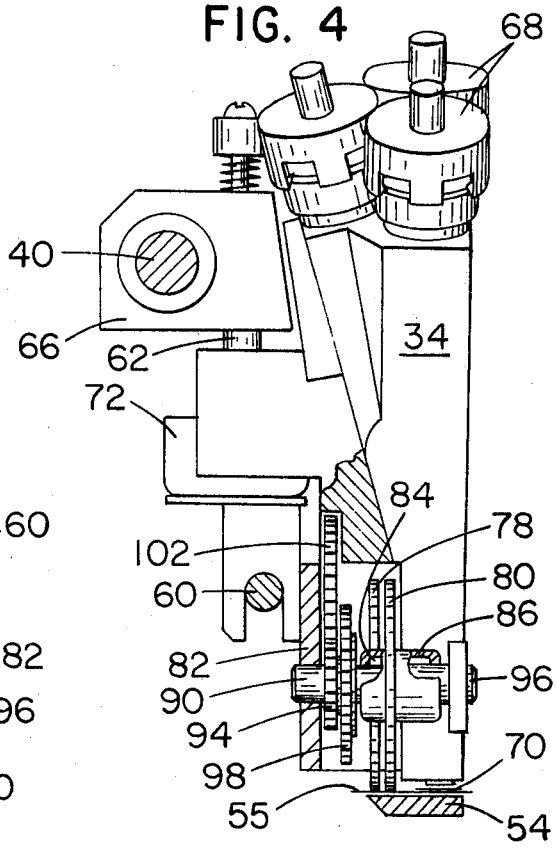
FIG. 4 is a left-side elevational view of the print head and ribbon drive mechanism.

The print head 34 includes the main body which supports a plurality of solenoids 68 for effecting operation of print wires (not shown) to impact on a ribbon 70 and against the paper 55 and the platen 54 (see also FIG. 4). The print head 34 also carries at the lower end thereof a pair of wheels 78 and 80 which are supported from framework 82 and ride over the document or record media 55 on which printing is to be done. The wheels 78, 80 are operably associatd with suitable overriding clutches 84, 86, the clutches being mounted on the respective wheel shafts and positioned 180°out of phase from each other to permit one whel 78 to be used to advance or drive the ribbon 70 as the print head 34 is traversed across the record media 55 in one direction, while the other wheel 80 used to advance or drive the ribbon in the same direction as the print head 34 is traversed across the record media 55 in the other direction. As best understood from FIG. 3, the clutch 84 is operable with a shaft 90 to be engageable with and disengageable therefrom, the clutch being of a common and suitable type for this purpose, and the wheel 78 is secured to the clutch 84 to drive the shaft 90 upon rotation of the wheel in one direction when the clutch 84 assumes the shaft engaged position, the shaft 90 also having a gear 92 and a gear 94 secured thereto. The clutch 86 is operable with a shaft 96 to be engageable with and disengageable therefrom in similar manner as clutch 84 and shaft 90, and the wheel 80 is secured to the clutch 86 to drive the shaft 96 to which is secured a gear 98 positioned to be engageable with gear 92. A shaft 100 for driving the ribbon 70 has a gear 102 secured thereto and positioned to be engageable with gear 94 on shaft 90, which shaft 100 extends forwardly past the print head 34 and includes an end portion 104 fitting into a cassette carried drive wheel 106 (FIGS. 1 and 2) engaging with the ribbon for driving thereof within the cassette 36. The precise details of the cassette and its ribbon drive are disclosed in the copending application, as noted above.

The operation of the ribbon driving mechanism is seen to be that as the print head 34 is moved in one direction, say from left to right as viewed in FIG. 1, or from right to left as viewed in FIG. 3, the wheel 78, being in frictional contact and engagement with the paper or document 55, rotates counterclockwise, as viewed in FIG. 3, which causes the overriding clutch 84, associated with the shaft 90, in the particular construction and operation thereof, to engage the shaft 90 and thereby drive gears 92 and 94 in the counterclockwise direction. Gear 94, in being engaged with gear 102, drives the gear 102, the shaft 100, and the drive wheel 106 in the clockwise direction (FIG. 3) for advancing the ribbon 70. At the same time, the overriding clutch 86 associated with wheel 80 disengages from its shaft 96 in regular manner and the wheel 80, being in frictional contact with the document or record media 55, also rotates counterclockwise, with the clutch 86 being disengaged from the shaft 96, such shaft being entirely free to rotate in the clockwise direction (FIG. 3), the gear 98 being idly driven in the clockwise direction by the gear 92. It is thus seen that in the right-to-left direction of travel of the print head 34, FIG. 3, the wheel 78 rotates counterclockwise and the clutch 84, being secured to the wheel 78 and in the engaged position with shaft 90, drives such shaft and the gears 92 and 94 secured thereto to drive gear 102 clockwise. At the same time, wheel 80 rotates counterclockwise, but clutch 86 is not engaged with shaft 96 to drive the shaft and the gear 98 secured thereto, but such shaft and gear are idly rotated by gear 92 in the clockwise direction.

As the print head 34 returns or moves in the opposite direction, wheel 78 is rotated clockwise, however its associated clutch 84 disengages in regular manner from the shaft 90, thereby freeing the wheel 78 from a driving condition. At the same time, wheel 80 also is rotated clockwise by the frictional contact of the paper or document 55 therewith, with the associated clutch 84 engaging the shaft 96 and thereby causing gear 98 to rotate clockwise (FIG. 3) — which movement rotates gears 92 and 94 counterclockwise to again drive gear 102 and shaft 100 carried drive wheel 106 clockwise to drive or advance the ribbon 70 in the same direction.

The direction of rotation of the ribbon drive shaft 100 and of the drive wheel 106 can be reversed by interchanging the clutch 84 and wheel 80 with the clutch 86 and wheel 78, in effect, by removing each wheel and its associated clutch and turning them over and installing them on their respective shafts, if it is desiired to advance the ribbon in the other direction. While the preferred construction includes the two wheels 78, 80 and their associated clutches 84, 86, it is, of course, feasible that a single wheel with associated control means can be utilized to effect advancing the ribbon 70 in the same direction regardless of the direction of rotation of the single wheel.

An additional feature of the ribbon drive mechanism is that the bearing journals for the shafts 90, 96, and 100 are supported from a bearing plate which is fabricated from low friction material, thereby eliminating the need for separate bearings for each shaft.

It is thus seen that herein shown and described is a drive mechanism for a ribbon in a cassette which is operably connected with the print head for use in printing operations. The apparatus provides for driving the ribbon in the same direction of rotation independent of the direction of travel of the print head and cassette. While only one embodiment of the invention has been disclosed herein, certain variations may occur to those skilled in the art, and it is contemplated that all such variations, not departing from the spirit and scope of the invention, are to be construed in accordance with the following claims.

What is claimed is:

1. In a printer having a ribbon and a ribbon advancement member, record media, and printing means carrying said member and movable across said record media, means engaged with said record media and rotatably driven thereby in response to frictional contact therewith, and means operably associated with said rotatably driven means and with said ribbon advancement member for advancing said ribbon in one direction independent of the direction of travel of said printing means in response to said frictional contact.

2. In the printer of claim 1 wherein said rotatably driven means comprises at least one roller member positioned to engage said record media.

3. In the printer of claim 1 wherein said associated means includes shaft and gear elements connected with said rotatable means for advancing said member in said one direction.

4. In the printer of claim 2 wherein said associated means includes gear elements connected with said roller member and a shaft and a gear driven thereby for advancing said member in said one direction.

5. In the printer of claim 1 including means permitting alternate operation of said associated means for advancing said member in said one direction.

6. Ribbon drive mechanism for a print head traversable in side-to-side manner, wheel means carried by said print head and engageable with record media for rotation of said wheel means in one or the other direction of rotation in response to frictional contact with said record media, gear means operably associated with said wheel means for rotation therewith, means permitting driving of said wheel means in one or the other direction of rotation dependent upon direction of travel of said print head, and means connected with said gear means for driving said ribbon in one direction.

7. The mechanism of claim 6 wherein said wheel means comprise a pair of wheels in contact with said record media.

8. The mechanism of claim 6 wherein said permitting means comprise overriding clutches operably associated with said wheel means.

9. The mechanism of claim 6 including shaft means for carrying said wheel means, said gear means, and said permitting means, and positioned and spaced to be operably associated with said gear means for rotation thereof in one or the other direction.

10. The mechanism of claim 6 including a first wheel and a second wheel engageable with and frictionally driven from said record media, each of said wheels being carried on a shaft and having a drive gear connected therewith and each of said shafts having an overriding clutch for driving of one wheel while permitting free rotation of the other wheel whereby said ribbon is driven in one direction independent of the direction of travel of said print head.

11. The mechanism of claim 6 including a pair of wheels and wherein said gear means comprise a drive gear connected with each of said wheels, a gear for driving said ribbon, and an interconnecting gear associated with one of said drive gears for driving said ribbon drive gear in the same direction of rotation.

12. In a printer having a print head movable across record media and printing thereon in one direction of travel, ribbon drive means comprising a plurality of wheels engageable with and frictionally driven from said record media, each of said wheels having a drive shaft and a drive gear associated therewith, clutch means associated with each of said shafts and wheels for driving one of said drive gears while permitting free rotation of another drive gear, an intermediate gear connected with one of said drive gears, and a driven shaft having a driven gear connected with said intermediate gear and responsive to the direction of rotation permitted by said clutch means for driving the ribbon during the printing direction of travel of the print head.

13. In the printer of claim 12 wherein said plurality of wheels comprise a first wheel and a second wheel spaced in overlapping relationship and wherein said clutch means comprise an overriding clutch permitting driving or non-driving of one of said drive gears.

14. In the printer of claim 12 wherein said clutch means is connected with said shafts and wheels for driving one of said drive gears and said ribbon in one direction of rotation thereof upon movement of said print head in the printing direction of travel, and said clutch means is connected with said shafts and wheels for driving another of said drive gears and said ribbon in the same direction of rotation thereof upon movement of the print head in the non-printing direction of travel.

15. In the printer of claim 12 wherein said driven gear is engageable with said intermediate gear to be rotated thereby and to drive said ribbon in the same direction of rotation independent of the direction of travel of said print head.

* * * * *